US006382102B1

(12) United States Patent
Herrmann et al.

(10) Patent No.: US 6,382,102 B1
(45) Date of Patent: May 7, 2002

(54) RUBBER BLANKET SLEEVE FOR AN OFFSET PRINTING MACHINE AND METHOD OF MAKING

(75) Inventors: Joachim Herrmann, Northeim; Stefan Fullgraf, Duderstadt; Karl-Herwig Dommes, Osterrode; Jürgen Reissmann; Thomas Moldenhauer, both of Northeim, all of (DE)

(73) Assignee: ContiTech Elastomer Beschichtungen GmbH, Hannover (DE)

( * ) Notice: Subject to any disclaimer, the term of this patent is extended or adjusted under 35 U.S.C. 154(b) by 0 days.

(21) Appl. No.: 09/645,330

(22) Filed: Aug. 25, 2000

(30) Foreign Application Priority Data

Aug. 26, 1999 (DE) ..... 199 40 429

(51) Int. Cl.[7] ..... B41N 10/04
(52) U.S. Cl. ..... 101/376; 101/217; 428/909
(58) Field of Search ..... 101/216, 217, 101/375, 376, 492, 493; 428/909

(56) References Cited

U.S. PATENT DOCUMENTS

| | | | | |
|---|---|---|---|---|
| 4,303,721 A | * | 12/1981 | Rodriguez | 428/213 |
| 5,304,267 A | * | 4/1994 | Vrotacoe et al. | 156/161 |
| 5,478,637 A | * | 12/1995 | Tomono et al. | 428/909 |
| 5,860,360 A | * | 1/1999 | Lane, III et al. | 428/909 |
| 5,884,559 A | * | 3/1999 | Okubo et al. | 101/376 |

FOREIGN PATENT DOCUMENTS

| | | |
|---|---|---|
| DE | 2700118 | 7/1977 |
| DE | 3027549 | 2/1981 |
| EP | 0514344 | 11/1992 |
| EP | 0452184 | 10/1995 |

OTHER PUBLICATIONS

An English Language abstract of EP 0 452 184.
German Publication No. DIN 16 621, (Oct., 1991).
German Publication No. DIN 53 504, (May, 1994).
Din 7724, Published Apr. 1993.

* cited by examiner

*Primary Examiner*—Leslie J. Evanisko
(74) *Attorney, Agent, or Firm*—Greenblum & Bernstein, P.L.C.

(57) ABSTRACT

Rubber blanket sleeve for a channel-free rubber blanket cylinder of an offset printing machine and process of producing rubber blanket sleeve. The rubber blanket sleeve includes an inner, dimensionally stable support sleeve arranged as a supporting layer, and a microporous compressible elastomer layer having a compressibility within a range between about 7% and 15% with a load of 100 N/cm$^2$. The elastomer layer includes a rubber matrix having a tensile stress of greater than about 2.2 N/mm$^2$ and less than about 15 N/mm$^2$ with 100% elongation. An outer covering rubber layer is arranged as a printing layer. All of the layers are composed of seamless, cylindrical bodies and are coupled to one another. The process includes arranging an inner, dimensionally stable support sleeve as a supporting layer, and positioning a microporous compressible elastomer layer having a compressibility within a range between about 7% and 15% with a load of 100 N/cm$^2$ over the support sleeve. The elastomer layer includes a rubber matrix having a tensile stress of greater than about 2.2 N/mm$^2$ and less than about 15 N/mm$^2$ with 100% elongation. The process further includes arranging an outer covering rubber layer as a printing layer, such that all of the layers are composed of seamless, cylindrical bodies and are coupled to one another.

20 Claims, 1 Drawing Sheet

RUBBER BLANKET SLEEVE FOR AN OFFSET PRINTING MACHINE AND METHOD OF MAKING

CROSS-REFERENCE TO RELATED APPLICATIONS

The present application claims priority under 35 U.S.C. §119 of German Patent Application No. 199 40 429.1, filed on Aug. 26, 1999, the disclosure of which is expressly incorporated by reference herein in its entirety.

BACKGROUND OF THE INVENTION

1. Field of the Invention

The present invention relates to a rubber blanket sleeve for a channel-free rubber blanket cylinder of an offset printing machine.

2. Discussion of Background Information

Rotary printing machines use open ended printing blankets which are clamped onto printing cylinders in such a way that an axially extending clamping point is produced on the cylinder circumference, which represents a dead zone for the printing process. Therefore rubber blanket cylinders with channel-free rubber blanket sleeves have already been proposed that do not require an axial clamping channel. DE 27 00 118 C2 discloses a rubber blanket sleeve which has a dimensionally stable support sleeve made of plastic or a metallic material, onto which are placed seamless cylindrical layers of elastic materials, preferably rubber. A rubber blanket sleeve that is completely free of gaps and seams is thus produced, which is slid axially over the rubber blanket cylinder and affixed. It is not necessary for a printing blanket to be clamped.

EP 0 452 184 B1 disclosed providing a rubber blanket sleeve with a base layer of celled rubber with a broad compression elasticity modulus range. A hard, fiber-reinforced elastomer layer is affixed to the outside of this rubber blanket sleeve. The outermost layer is the usual covering rubber layer for the printing process.

EP 0 514 344 B1 discloses a gap-free rubber blanket sleeve, which has a seamlessly affixed, celled, compressible elastomer layer on a cylindrical support sleeve. This celled, compressible layer is encompassed by a layer which cannot be stretched in the circumferential direction. The outermost layer is the elastomer printing layer, which is known per se. The non-stretchable layer acts as a kind of binding band for the celled, compressible layer. By increasing the shearing rigidity of the compressible layer, this binding band limits the deformation that occurs with the unwinding contact during printing. By the initial stress exerted, the circumferentially non-stretchable layer sets the shearing rigidity of the rubber blanket sleeve, while its disposition underneath the outer printing layer effectively prevents this outer layer from moving in the circumferential direction, i.e., from forming a bead or bulge.

The production of the rubber blanket sleeve is very expensive due to the mounting of the non-stretchable layer. The compressibility of the rubber blanket sleeve is influenced by the properties of the binding band. The inevitable tolerance with regard to the winding tension of the binding band can lead to an insufficient uniformity of the properties of the product. But a more uniform production of the rubber blanket sleeve must be achieved in order to improve printing quality.

SUMMARY OF THE INVENTION

The present invention provides a rubber blanket sleeve of the type described at the outset which permits a good printing quality at a lower cost while preventing the formation of a bead or a bulge during unwinding contact of the outer printing layer.

In particular, the rubber blanket sleeve of the instant invention includes an inner, dimensionally stable support sleeve as a supporting layer and a thin bonding agent layer affixed thereto. A microporous, closed pore-containing, compressible elastomer layer is provided having a compressibility of the elastomer layer falling within the range between about 7% and 15% with 100 N/cm$^2$ of load. The rubber matrix of the compressible layer has a tensile stress of greater than about 2.2 N/mm$^2$ and less than about 15 N/mm$^2$ with 100% elongation. A thin layer of a bonding agent is applied to the elastomer layer, an outer covering rubber layer is provided as a printing layer, and of the layers are composed of seamless, cylindrical bodies and are affixed to one another.

The compressible elastomer layer usually contains gas-filled hollow spaces which produce the compressibility of the entire structure due to the compression of the enclosed gas. The number and size of the gas bubbles here are set so that the compressibility falls in the range between about 7% and 15% with 100 N/cm$^2$ of load (tested according to DIN 16 621). At issue is the relative compressibility, which represents the average thickness reduction with regard to the actual thickness, indicated in %, in the loading cycle defined by the DIN norm 16 621. The rubber matrix of the compressible layer, i.e., the rubber mixture without taking into consideration the hollow spaces contained therein, has a tensile stress of at least about 2.2 N/mm$^2$ and at most about 15 N/mm$^2$ with 100% elongation (tested according to DIN 53 504).

Surprisingly, it was noted out that a sufficient shearing rigidity of the compressible layer is achieved even without a reinforcing binding band that extends over the microporous layer.

In an advantageous embodiment of the invention, the microporous elastomer layer contains reinforcing materials. These materials are incorporated into the compressible layer during its manufacture. The shearing rigidity of the microporous elastomer layer can be variously selected by the reinforcing materials contained in it.

In another advantageous embodiment of the invention, the reinforcing materials are mixed-in short fibers or embedded nonwoven mats. The short fibers are already mixed in during the production of the rubber mixture for the microporous layer. The short fibers increase the shearing rigidity of the compressible layer beyond the known measure associated with elastomers.

In another advantageous embodiment of the invention, the reinforcing materials are woven cloth layers of foils. The microporous layer is thereby reinforced and its shearing rigidity is thus increased.

In another advantageous embodiment of the invention, a woven cloth, a foil, or a knitted cloth is affixed between the support sleeve and the microporous layer. During manufacture, this cloth or foil layer can function as a receiving support for the microporous layer and, at the same time, with the interposition of a suitable bonding agent, can provide for a favorable bonding to the metallic support sleeve. Therefore, the costly separation of the microporous layer and receiving support before the actual coating of the support sleeve can be avoided.

The invention produces a rubber blanket sleeve which does not require an outer binding band around the compressible layer and nevertheless assures a sufficient shearing rigidity of the compressible layer. The shearing rigidity of the compressible layer is further increased by the additional embodiments of the invention. The material dampening is also increased at the same time, as a result of which the rubber blanket sleeve can favorably dampen vibrations of the rubber blanket cylinder supporting it in the printing machine.

The present invention is directed to a rubber blanket sleeve for a channel-free rubber blanket cylinder of an offset printing machine. The rubber blanket sleeve includes an inner, dimensionally stable support sleeve arranged as a supporting layer, and a microporous compressible elastomer layer having a compressibility within a range between about 7% and 15% with a load of 100 N/cm$^2$. The elastomer layer includes a rubber matrix having a tensile stress of greater than about 2.2 N/mm$^2$ and less than about 15 N/mm$^2$ with 100% elongation. An outer covering rubber layer is arranged as a printing layer. All of the layers are composed of seamless, cylindrical bodies and are coupled to one another.

In accordance with a feature of the instant invention, a thin bonding agent layer can be affixed to the support sleeve, and a thin layer of a bonding agent can be applied to the microporous elastomer layer. The thin bonding agent layer affixed to the support sleeve may be structured and arranged to affix the support sleeve to the microporous elastomer layer, and the thin layer of bonding agent applied to the elastomer layer may be structured and arranged to affix the microporous elastomer layer to the outer covering rubber layer. The microporous elastomer layer includes closed pores.

In accordance with another feature of the invention, the microporous elastomer layer may contain reinforcing materials. The microporous elastomer layer may include short fibers which are mixed therein. Further, the microporous elastomer layer may include woven cloth layers or foils.

According to still another feature of the present invention, one of a woven cloth, a foil, and a knitted cloth can be affixed between the support sleeve and the microporous elastomer layer. Further, a thin bonding agent layer can be affixed to the support sleeve, a thin bonding agent layer can be applied to the one of the woven cloth, foil, and knitted cloth, and a thin layer of a bonding agent can be applied to the microporous elastomer layer. In this way, the thin bonding agent layer affixed to the support sleeve may be structured and arranged to affix the support sleeve to the one of the woven cloth, foil, and knitted cloth, the thin bonding agent layer affixed to the one of the woven cloth, foil, and knitted cloth may be structured and arranged to affix the one of the woven cloth, foil, and knitted cloth to the microporous elastomer layer, and the thin layer of bonding agent applied to the elastomer layer may be structured and arranged to affix the microporous elastomer layer to the outer covering rubber layer.

The present invention is directed to a rubber blanket sleeve for a channel-free rubber blanket cylinder of an offset printing machine. The rubber blanket sleeve includes an inner, dimensionally stable support sleeve arranged as a supporting layer, a thin bonding agent layer affixed to the support sleeve, and a microporous, closed pore, compressible elastomer layer having a compressibility within a range between about 7% and 15% with a load of 100 N/cm$^2$. The elastomer layer includes a rubber matrix having a tensile stress of greater than about 2.2 N/mm$^2$ and less than about 15 N/mm$^2$ with 100% elongation. A thin layer of a bonding agent is applied to the microporous elastomer layer, and an outer layer covering rubber layer is arranged as a printing layer. All of the layers are composed of seamless, cylindrical bodies and are affixed to one another.

The present invention is directed to a process of producing a rubber blanket sleeve for a channel-free rubber blanket cylinder of an offset printing machine. The process includes arranging an inner, dimensionally stable support sleeve as a supporting layer, and positioning a microporous compressible elastomer layer having a compressibility within a range between about 7% and 15% with a load of 100 N/cm$^2$ over the support sleeve. The elastomer layer includes a rubber matrix having a tensile stress of greater than about 2.2 N/mm$^2$ and less than about 15 N/mm$^2$ with 100% elongation. The process further includes arranging an outer covering rubber layer as a printing layer, such that all of the layers are composed of seamless, cylindrical bodies and are coupled to one another.

According to a feature of the present invention, the process can further include affixing a thin bonding agent layer to the support sleeve, and applying a thin layer of a bonding agent to the microporous elastomer layer. The process may also include affixing the support sleeve to the microporous elastomer layer with the thin bonding layer affixed to the support sleeve, and affixing the microporous elastomer layer to the outer covering rubber layer with the thin layer of bonding agent applied to the elastomer layer.

In accordance with another feature of the invention, the process can include forming the microporous elastomer layer to include reinforcing materials. The microporous elastomer layer can include short fibers which are mixed therein. Further, the microporous elastomer layer can include woven cloth layers or foils.

According to sill yet another feature of the present invention, the process can further include coupling one of a woven cloth, a foil, and a knitted cloth between the support sleeve and the microporous elastomer layer. The process can also include affixing a thin boding agent layer to the support sleeve, applying a thin bonding agent layer to the one of the woven cloth, foil, and knitted cloth, and applying a thin layer of a bonding agent to the microporous elastomer layer. Moreover, the process can include affixing the support sleeve to the one of the woven cloth, foil, and knitted cloth with the thin bonding layer affixed to the support sleeve, affixing the one of the woven cloth, foil, and knitted cloth to the microporous elastomer layer with the thin bonding agent layer affixed to the one of the woven cloth, foil, and knitted cloth, and affixing the microporous elastomer layer to the outer covering rubber layer with the thin layer of bonding agent applied to the elastomer layer.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
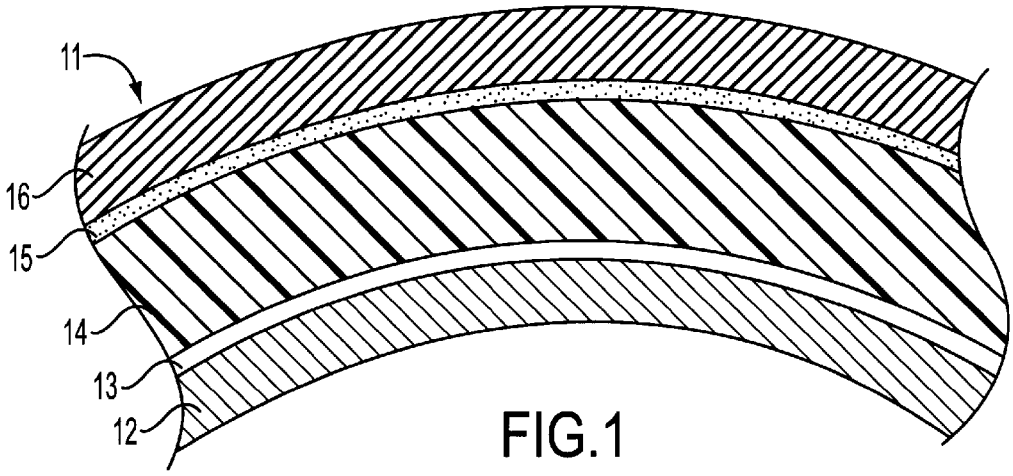
FIG. 1 illustrates the structure of a rubber blanket sleeve in a detailed sectional view.

The rubber blanket sleeve 11, a detail of which is shown in FIG. 1, has a cylindrical support sleeve 12 composed of metallic material, e.g., composed of steel plate or nickel plate.

In a seamless, cylindrical device, a thin layer of a rubber-to-metal bonding agent 13 is applied to support sleeve 12, which permits the sleeve to be bonded to a microporous elastomer layer 14 with closed pores, which is compressible. Bonding agent 13 is selected so that it produces an optimal bond between support sleeve 12 and compressible layer 14. Typical values of cohesion strength, measured in accordance with DIN 53 530, are between about 2 N/mm and 5 N/mm.

Compressible layer 14 contains gas-filled hollow spaces which produce the compressibility of the entire structure due to the compression of the enclosed gas. The number and size of the bubbles in this connection are set so that the compressibility falls in the range, e.g., between about 7% and 15%, measured in accordance with DIN 16 621.

Furthermore, the shearing rigidity of the compressible layer 14 is designed so that a reinforcing binding band is not required to be arranged above it. The rubber matrix here has been selected so that its tensile stress with 100% elongation is, e.g., greater than about 2.2 $N/mm^2$ and less than about 15 $N/mm^2$.

A thin layer 15 of adhesive rubber is affixed to the outer circumference of microporous elastomer layer 14. Rubber solutions based on nitrile rubber are typically used for this purpose. Adhesive rubber layer 15 bonds covering rubber layer 16, which is crucial for the printing process, to the ground surface. This covering rubber layer 16 can have a thickness of, e.g., approximately 0.3 mm.

Figure 2:
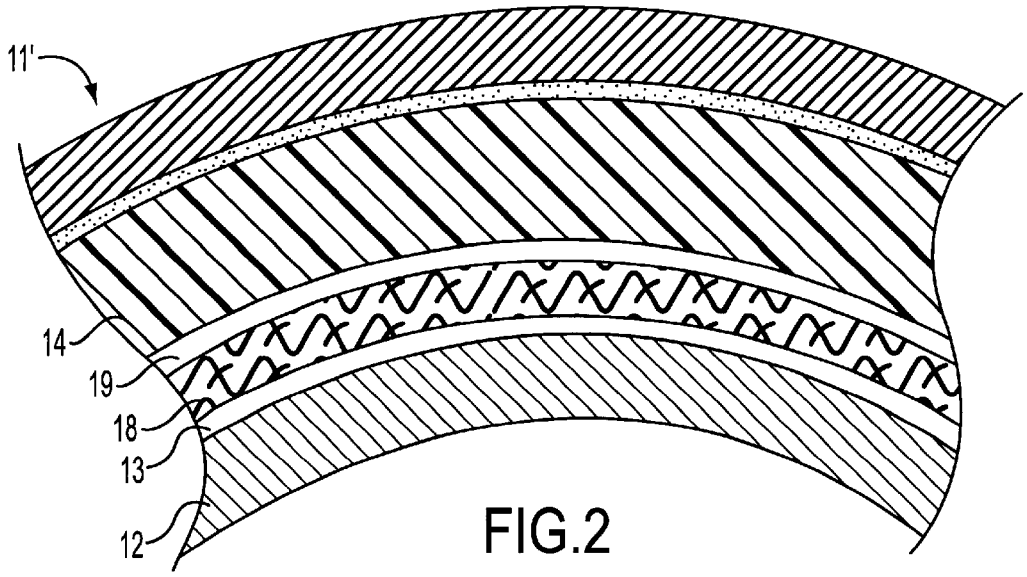
FIG. 2 illustrates a modified rubber blanket sleeve, which has a woven cloth between the compressible layer and the support sleeve.

A modified rubber blanket sleeve 11', a detail of which is shown in FIG. 2, includes an additional rubberizes woven cloth layer 18, which is inserted between support sleeve 12 and microporous elastomer layer 14. Rubberized woven cloth layer 18 is bonded to support sleeve 12 by a thin layer of a rubber-to-metal bonding agent 13. On the other outer surface, woven cloth layer 18 is covered with a thin layer 19 composed of a suitable adhesive rubber which allows for the bonding of microporous elastomer layer 14.

Figure 3:
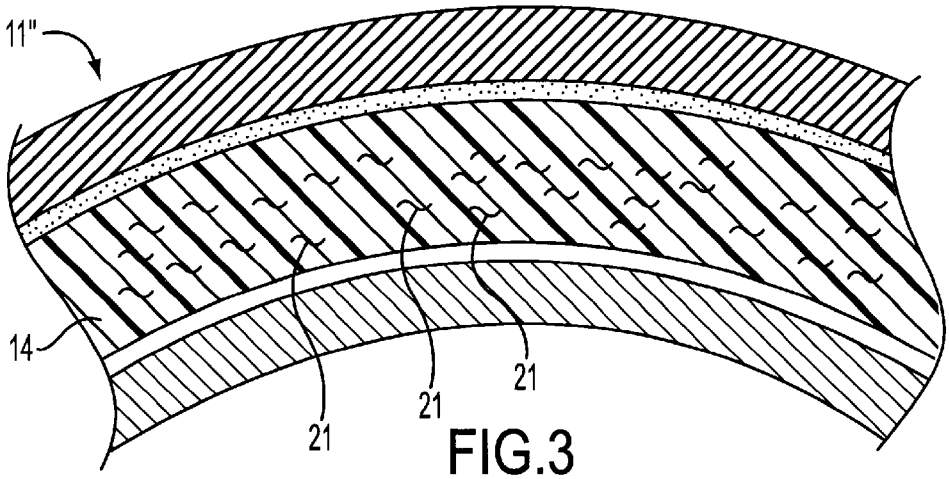
FIG. 3 illustrates another modified rubber blanket sleeve whose compressible microporous layer has short fibers mixed into it.

Rubber blanket sleeve 11" according to FIG. 3 is distinguished from the other two embodiments described above in that microporous elastomer layer 14' contains reinforcing short fibers 21, which are distributed in an essentially uniform manner within microporous elastomer layer 14'. This produces a strength increase in microporous elastomer layer 14'. As a result, the shearing rigidity is also increased beyond the known measure associated with elastomers.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A rubber blanket sleeve for a channel-free rubber blanket cylinder of an offset printing machine comprising:

an inner, dimensionally stable support sleeve arranged as a supporting layer;

a microporous compressible elastomer layer having a compressibility within a range between about 7% and 15% with a load of 100 $N/cm^2$;

said elastomer layer comprising a rubber matrix having a tensile stress of greater than about 2.2 $N/mm^2$ and less than about 15 $N/mm^2$ with 100% elongation; and an outer covering rubber layer arranged as a printing layer, wherein all of the layers are composed of seamless, cylindrical bodies and are coupled to one another.

2. The rubber blanket sleeve in accordance with claim 1, further comprising:

a thin bonding agent layer affixed to said support sleeve; and a thin layer of a bonding agent applied to said microporous elastomer layer.

3. The rubber blanket sleeve in accordance with claim 2, wherein said thin bonding agent layer affixed to said support sleeve is structured and arranged to affix said support sleeve to said microporous elastomer layer, and wherein said thin layer of bonding agent applied to the elastomer layer is structured and arranged to affix said microporous elastomer layer to said outer covering rubber layer.

4. The rubber blanket sleeve in accordance with claim 2, wherein said microporous elastomer layer comprises closed pores.

5. The rubber blanket sleeve in accordance with claim 1, wherein said microporous elastomer layer contains reinforcing materials.

6. The rubber blanket sleeve in accordance with claim 5, wherein said microporous elastomer layer comprises short fibers which are mixed therein.

7. The rubber blanket sleeve in accordance with claim 5, wherein said microporous elastomer layer comprises woven cloth layers or foils.

8. The rubber blanket sleeve in accordance with claim 1, further comprising one of a woven cloth, a foil, and a knitted cloth being affixed between said support sleeve and said microporous elastomer layer.

9. The rubber blanket sleeve in accordance with claim 8, further comprising:

a thin bonding agent layer affixed to said support sleeve;

a thin bonding agent layer applied to said one of said woven cloth, foil, and knitted cloth; and a thin layer of a bonding agent applied to said microporous elastomer layer.

10. The rubber blanket sleeve in accordance with claim 9, wherein said thin bonding agent layer affixed to said support sleeve is structured and arranged to affix said support sleeve to said one of said woven cloth, foil, and knitted cloth;

wherein said thin bonding agent layer applied to said one of said woven cloth, foil, and knitted cloth is structured and arranged to affix said one of said woven cloth, foil, and knitted cloth to said microporous elastomer layer; and wherein said thin layer of bonding agent applied to the elastomer layer is structured and arranged to affix said microporous elastomer layer to said outer covering rubber layer.

11. A rubber blanket sleeve for a channel-free rubber blanket cylinder of an offset printing machine comprising:

an inner, dimensionally stable support sleeve arranged as a supporting layer;

a thin bonding agent layer affixed to said support sleeve;

a microporous, closed pore, compressible elastomer layer having a compressibility within a range between about 7% and 15% with a load of 100 $N/cm^2$;

said elastomer layer comprising a rubber matrix having a tensile stress of greater than about 2.2 $N/mm^2$ and less than about 15 $N/mm^2$ with 100% elongation;

a thin layer of a bonding agent applied to said microporous elastomer layer; and an outer covering rubber layer arranged as a printing layer, wherein all of the layers are composed of seamless, cylindrical bodies and are affixed to one another.

12. A process of producing a rubber blanket sleeve for a channel-free rubber blanket cylinder of an offset printing machine, the process comprising:

arranging an inner, dimensionally stable support sleeve as a supporting layer;

positioning a microporous compressible elastomer layer having a compressibility within a range between about 7% and 15% with a load of 100 $N/cm^2$ over the support sleeve, wherein the elastomer layer comprises a rubber matrix having a tensile stress of greater than about 2.2 $N/mm^2$ and less than about 15 $N/mm^2$ with 100% elongation; and arranging an outer covering rubber layer as a printing layer, wherein all of the layers are composed of seamless, cylindrical bodies and are coupled to one another.

13. The process in accordance with claim 12, further comprising:

affixing a thin bonding agent layer to the support sleeve; and applying a thin layer of a bonding agent to the microporous elastomer layer.

14. The process in accordance with claim 13, further comprising:

affixing the support sleeve to the microporous elastomer layer with the thin bonding layer affixed to the support sleeve, and affixing the microporous elastomer layer to the outer covering rubber layer with the thin layer of bonding agent applied to the elastomer layer.

15. The process in accordance with claim 12, further comprising forming the microporous elastomer layer to include reinforcing materials.

16. The process in accordance with claim 15, wherein the microporous elastomer layer comprises short fibers which are mixed therein.

17. The process in accordance with claim 15, wherein the microporous elastomer layer comprises woven cloth layers or foils.

18. The process in accordance with claim 12, further comprising:

coupling one of woven cloth, a foil, and a knitted cloth between the support sleeve and the microporous elastomer layer.

19. The process in accordance with claim 18, further comprising:

affixing a thin bonding agent layer to the support sleeve;

applying a thin bonding agent layer to the one of the woven cloth, foil, and knitted cloth; and applying a thin layer of a bonding agent to the microporous elastomer layer.

20. The process in accordance with claim 19, further comprising:

affixing the support sleeve to the one of the woven cloth, foil, and knitted cloth with the thin bonding layer affixed to the support sleeve;

affixing the one of the woven cloth, foil, and knitted cloth to the microporous elastomer layer with the thin bonding agent layer applied to the one of the woven cloth, foil, and knitted cloth; and affixing the microporous elastomer layer to the outer covering rubber layer with the thin layer of bonding agent applied to the elastomer layer.

* * * * *